US006844126B2

(12) United States Patent
Ohmura et al.

(10) Patent No.: US 6,844,126 B2
(45) Date of Patent: Jan. 18, 2005

(54) ELECTROSTATIC LATENT IMAGE DEVELOPING TONER AND IMAGE FORMING METHOD

(75) Inventors: Ken Ohmura, Hachiozi (JP); Asao Matsushima, Hino (JP); Shiro Hirano, Hachioji (JP); Hiroshi Yamazaki, Hachioji (JP)

(73) Assignee: Konica Corporation, Tokyo (JP)

( * ) Notice: Subject to any disclaimer, the term of this patent is extended or adjusted under 35 U.S.C. 154(b) by 63 days.

(21) Appl. No.: 10/310,726

(22) Filed: Dec. 4, 2002

(65) Prior Publication Data

US 2003/0148204 A1 Aug. 7, 2003

(30) Foreign Application Priority Data

Dec. 10, 2001 (JP) ..... 2001-375620

(51) Int. Cl.[7] ..... G03G 9/087
(52) U.S. Cl. ..... 430/110.3; 430/110.4
(58) Field of Search ..... 430/110.3, 110.4

(56) References Cited

U.S. PATENT DOCUMENTS 6,475,689 B2 * 11/2002 Yamazaki et al. ..... 430/108.4

* cited by examiner

*Primary Examiner*—Mark A. Chapman
(74) *Attorney, Agent, or Firm*—Squire, Sanders & Dempsey

(57) ABSTRACT

An electrostatic latent image developing toner is disclosed. The toner particles has an average of circularity of 0.94 to 0.98; an average of circle equivalent diameter of 2.6 to 7.4 μm; and gradient of the circularity with respect to the circle-equivalent diameter of −0.050 to −0.010.

27 Claims, 2 Drawing Sheets

ELECTROSTATIC LATENT IMAGE DEVELOPING TONER AND IMAGE FORMING METHOD

FIELD OF THE INVENTION

The present invention relates to an electrostatic latent image developing toner and an image forming method using the same.

BACKGROUND OF THE INVENTION

In recent years, due to the progress of digital image processing techniques, digital type image formation has become a mainstream even in image forming methods utilizing electrophotography in which electrostatic latent images are developed.

The digital type image forming method is based on the visualization of latent images comprised of minute dots such as 1,200 dpi (dots per inch; the number of dots per 2.54 cm). Therefore, high image quality techniques are sought which faithfully reproduces such minute dot images. In order to realize such high image quality, electrostatic latent image developing toner has been subjected to a decrease in toner particle diameter as well as a decrease in the range of the particle size distribution and an increase in particle shape uniformity.

In image forming methods which develop electrostatic latent images, heretofore, so-called pulverized toner has mainly been employed, which is prepared in such a manner that binder resins and pigments are mix-kneaded, subsequently pulverized, and the resulting toner powder is classified. However, such pulverized toner exhibits limit in the decrease of toner particle diameter as well as the decrease in the particle size distribution range and uniformity of particle shape. As a result, it has been difficult to produce the desired increasingly high quality images as long as such pulverized toner is employed.

In recent years, attention has given to so-called polymerization method toner which is prepared employing either a suspension polymerization method or an emulsion polymerization method as a means to achieve a decrease in the diameter of toner particles as well as the uniformity of the particle size distribution and the shape. The polymerization method toner is prepared in such a manner that monomers as a raw material are uniformly dispersed in a water based medium, followed by polymerization and then employed. Various methods to prepare the polymerization method toner are known. Of these, a method, which receives marked attention, is that resinous particles, prepared by the suspension polymerization method or the emulsion polymerization method, are coalesced (salting out and fusion) with colorant particles. This method makes it easy to prepare toner particles having a smaller diameter and a more uniform particle size distribution. As a result, its practical application has been investigated, however, the aspect of its production engineering is still during the stage of development.

On the other hand, widely accepted as methods to fix toner images formed on image forming supports, such as paper, is heating roller fixing which achieves fixing by transporting the image forming support, on which said toner images are formed, between a heating roller and a pressure roller.

However, when the heating roller fixing is applied to the polymerization method toner comprising small diameter toner particles and exhibiting uniform particle size distribution as well as uniform shape, problems occur in which insufficient fixing results, due to the fact that toner particles are not sufficiently deformed so as to fit into the unevenness of paper as well as the unevenness of the surface of the heating roller.

SUMMARY OF THE INVENTION

It is an object of the present invention to provide an electrostatic latent image developing toner which makes it possible to form high quality images without resulting in insufficient fixing in such a manner that when a polymerization method toner, comprising small diameter toner particles and exhibiting uniform particle size distribution and shape, is employed in a printer utilizing heating roller fixing, toner particles are sufficiently deformed so as to fit into the unevenness of paper, as well as the unevenness of the heating roller, and an image forming method using the same.

The inventors of the present invention discovered that fixability was markedly enhanced by allowing relatively large toner particles to exist in toner comprising small diameter particles and exhibiting uniform particle size disturbing as well as uniform shape in an addition amount range which does not adversely affect image quality.

However, when the shape and particle size distribution of the "relatively large toner particles", employed herein, are not sufficiently controlled and are different from the component comprised of small diameter toner particles, problems are caused in which non-uniform development, as well as non-uniform transfer, occur due to differences in particle diameter.

When toner having a definite shape, as well as definite particle size distribution, is employed, generally, larger toner particles are subjected to initial development as well as initial transfer, while smaller toner particles are occasionally subjected to neither development nor transfer. When such non-uniform development, as well as such non-uniform transfer continues, the resulting resolution is degraded due to scattering of toner to the periphery of dot images. In addition, problems are occasionally caused as follows. Components of the small diameter toner accumulate in the development unit, whereby the development rollers are subjected to melt adhesion. Due to that, toner is subjected to insufficient charging, whereby background staining results and toner scattering occur. Further, in the transfer process, problems occur such as insufficient transfer as well as non-uniform images due to photoreceptor filming.

In order to overcome the drawbacks such as stated above, the toner of the present invention is comprised of relatively small particles having uniform diameter capable of being subjected to simultaneous development and transfer, as well as relatively large particles which are not perfectly spherical but somewhat randomly shaped so that development is not carried out depending on the particle diameter and transfer is not carried out even though developed. Due to that, the toner exhibits a gradient of particle diameter and circularity. However, the shape as well as the diameter of the relatively small particles is uniform, and particles smaller than that, and having a different shape, are rarely included. As a result, the small particle diameter portion exhibits no particle size distribution.

The present invention and the embodiments thereof will now be described.

An electrostatic latent image developing toner wherein the average of circularity is from 0.94 to 0.98; the average of circle equivalent diameter is from 2.6 to 7.4 $\mu$m; and the gradient of the circularity with respect to the circle-equivalent diameter is from −0.050 to −0.010.

It is preferable that the average of the circle-equivalent diameter is from 3.4 to 6.6 μm, and the gradient of the circularity with respect to the circle-equivalent diameter is from −0.040 to −0.020.

It is preferable that ratio $d_{90}/d_{10}$ is from 1.2 to 1.8, wherein $d_{10}$ is the circular-equivalent diameter at an accumulation of 10 percent and $d_{90}$ is the circle-equivalent diameter at an accumulation of 90 percent.

It is preferable that toner is comprised of said toner particles which are prepared by polymerizing at least a polymerizable monomer in an aqueous medium.

Toner is preferred which is prepared by salting out/fusing at least resinous particles in an aqueous medium.

It is preferable that the BET specific surface area is from 1.1 to 4.0 $m^2/g$, the surface existing ratio of silicon atoms, which is determined employing ESCA, is from 6 to 12 percent by area, and the existing ratio of carbon atoms is from 50 to 75 percent by area.

Said toner is suitably applied to the image forming method in which exposure onto a photoreceptor is carried out employing digital exposure.

It is possible to employ said toner as a double component developer upon being blended with a magnetic carrier.

DETAILED DESCRIPTION OF THE INVENTION

Figure 1:
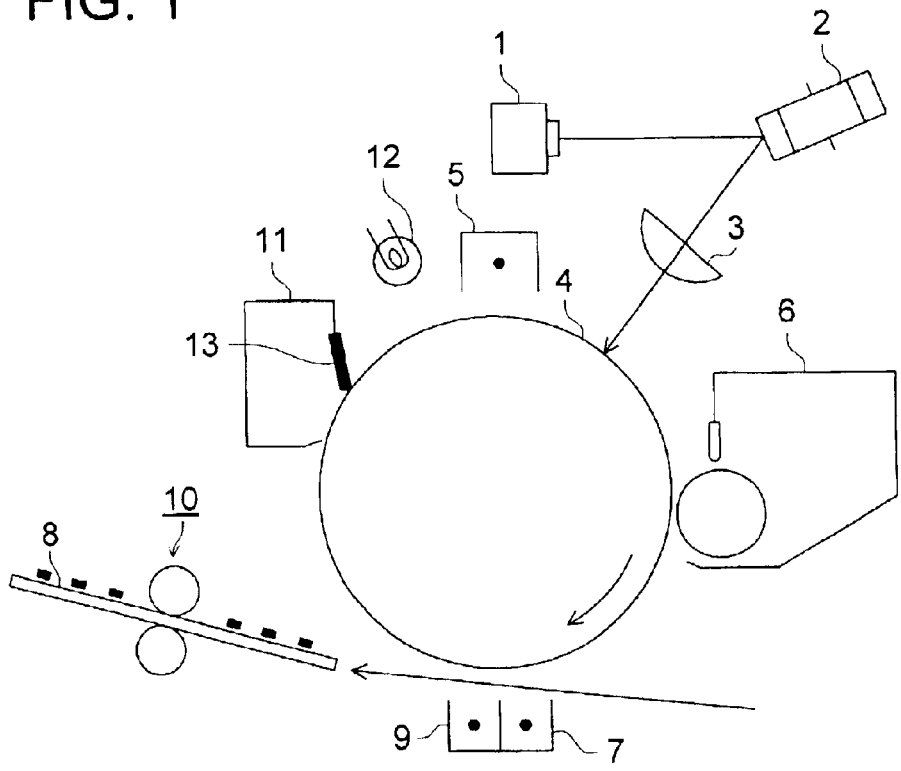
FIG. 1 is a view showing one example of the schematic structure of the image forming method and image forming apparatus of the present invention.

When at least 2,000 toner particles, having a diameter of at least 1 μm in said toner, are measured, the average of circularity represented by the formula, described below, is preferably from 0.94 to 0.98, and is more preferably from 0.93 to 0.97.

Circularity=(circle-equivalent peripheral length)/(peripheral length of the projected image of a toner particle)=2π×(projected area of the toner particle/π)$^{1/2}$/(peripheral length of projected image of the toner particle)

wherein the equivalent circle, as described herein, is a circle having the same area as the projected image of the toner and the circle-equivalent diameter is the diameter of said equivalent circle.

Accordingly, the circle-equivalent diameter is defined by the formula shown below.

Circle-equivalent diameter=2×(projected area of a particle)/π)$^{1/2}$

Incidentally, it is possible to determine the aforesaid circularity, employing FPIA-2000 (produced by Sysmex Corporation).

The toner of the present invention has a circle-equivalent diameter average of 2.6 to 7.4 μm, and a circularity gradient, with respect to the circle-equivalent diameter, of −0.050 to −0.010. The circle-equivalent diameter average is preferably from 3.4 to 6.6 μm and the circularity gradient with respect to the circle-equivalent diameter is preferably from −0.040 to −0.020.

The circle-equivalent diameter gradient is determined as follows. The circle-equivalent diameter of the projected image of a toner particle is measured employing a flow type particle image analyzer, FPIA-2000. The relationship between the resulting circle-equivalent diameter and the circularity corresponding to the diameter is drawn while the circle-equivalent diameter (in μm) is taken as abscissa x, and the circularity is taken as ordinate y. Based on the result, the primary relationship (y=αx+b) is obtained, whereby α is the gradient of the circle-equivalent diameter.

In such cases, from the viewpoint of enhancing charging uniformity as well as halftone uniformity, a decision coefficient expressed by squared correlation coefficient R represented by the formula described below is preferably from 0.35 to 0.95. Since dot reproduction is enhanced due to the correlation above a certain degree, the halftone uniformity is also enhanced thereby. On the other hand, when correlation is excessively high, adhesion force to a photoreceptor and the like increases unexpectedly, whereby the dot reproduction is degraded and the halftone uniformity is also degraded.

$$R = \frac{n\left(\sum XY\right) - \left(\sum X \sum Y\right)}{\left[n\sum X^2 - \left(\sum X\right)^2\right]\left[n\sum Y^2 - \left(\sum Y\right)^2\right]}$$

wherein X is the circle-equivalent diameter and Y is the circularity.

The toner of the present invention may be prepared as follows. By adding toner which is comprised of particles having different diameter and shape, it is possible to control the circularity average, circle-equivalent diameter average, and circularity gradient so as to satisfy the conditions of the present invention.

On the other hand, a method, in which toner is prepared by salting-out/fusing resinous particles and colorant particles, is also a preferred method. By employing this method, it is possible to prepare a toner which satisfies the conditions of the present invention in the following manner. A coagulant is added during the salting-out/fusion process. Subsequently, during the stage in which fusion is carried out while heated, conditions are set in which relatively large particles are provided by shearing forces, namely, relatively large particles are irregularly shaped through high speed stirring under a turbulent flow so as to form toner which satisfies the conditions of present invention. Further, a method is also preferred in which, during the fusion stage, relatively high heating temperature is employed so that toner particles, having a smaller diameter, attain a more spherical shape. It is desirable that the heating temperature is at least 20° C. higher than the glass transition temperature of the resinous particles, and is preferably at least 30° C. higher then the same. By setting such temperature conditions, small diameter particles, having a small heat capacity, tend to become more spherical.

In the toner production method employing salting-out/fusion, terminating agents, which terminate particle growth due to salting-out/fusion after reaching the specified diameter, are added during salting out/fusion of the resinous particles and the colorant particles. A preferred method, which prepares the toner of the present invention, includes a method in which, during these stages, additional particle growth such as about 0.2 to 1.0 μm is carried out by adding the salting-out agents and further adding surface active agents. By so doing, it is possible to control the relationship between the particle diameter and the particle shape so as to satisfy the conditions of the present invention.

In the present invention, from the viewpoint of optimizing the toner charge distribution, ratio $d_{90}/d_{10}$ is preferably from 1.2 to 2.0, wherein $d_{10}$ is the circle-equivalent diameter at an accumulation from the smallest toner particle diameter of 10 percent by number and $d_{90}$ is the equivalent diameter at an accumulation from the smallest toner particle diameter of 90 percent by number. When the ratio is controlled within this range, it is possible to control the dust of dots. As a result, it is possible to produce high quality images having high halftone uniformity.

$D_{10}$ and $D_{90}$ will be explained below employing FIG. 2.

Figure 2:
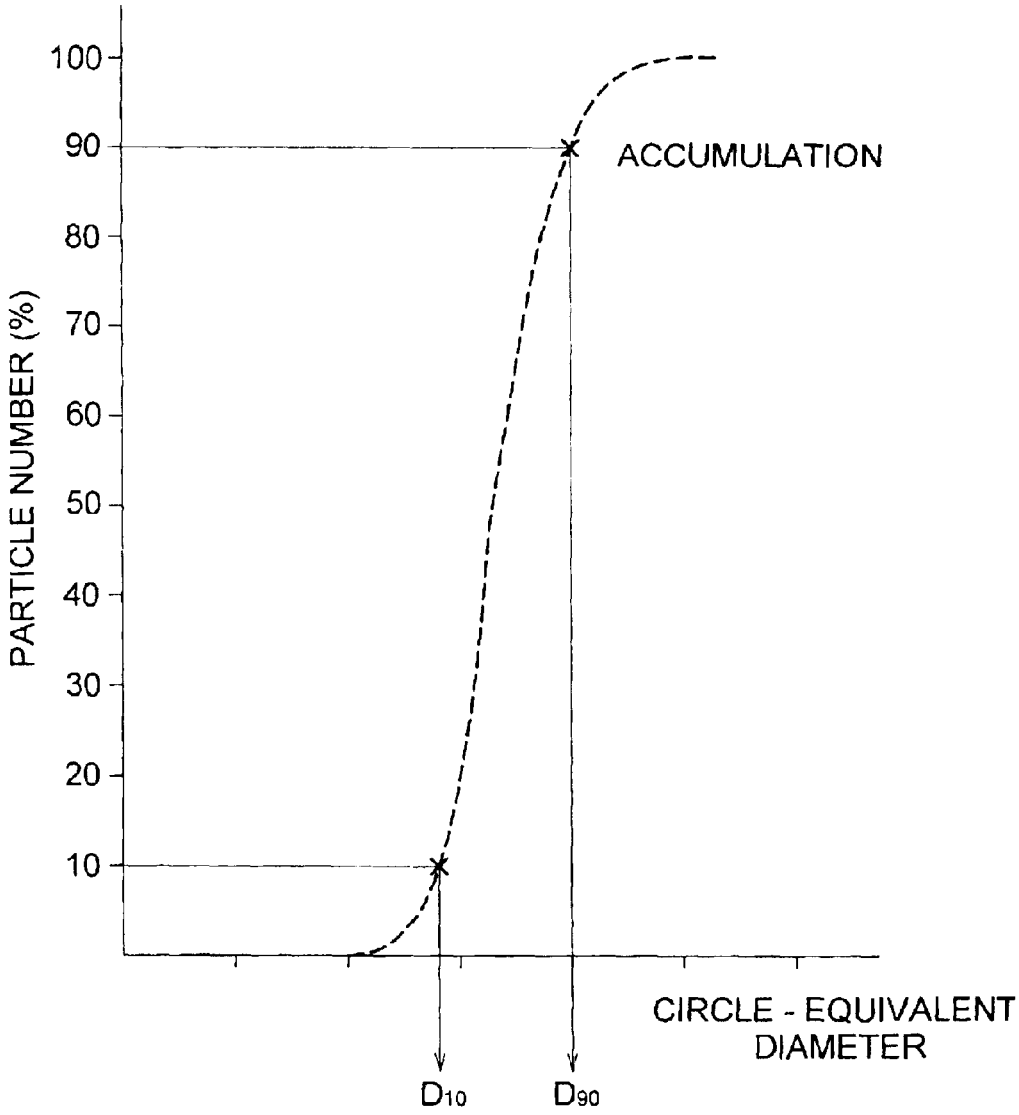
FIG. 2 is a graph showing number of accumulated toner particles to explain $D_{10}$ and $D_{90}$.

In FIG. 2, the curve of the integral of the equivalent diameter of the toner particles distribution function is shown in a broken line in a coordinate in which the equivalent diameter of the toner particles is plotted in the abscissa and the particle number corresponding to the equivalent diameter is plotted in an ordinate. $D_{10}$ and $D_{90}$ are shown by the crossed lines the points of 10 percent and 90 percent by number of the total toner particles and the points of the equivalent diameter of the toner particles corresponding to them.

Toner is preferred in which minute silica particles are incorporated as an external additive. In such toner, from the viewpoint of minimizing partial transfer, as well as selective development, it is preferable that the BET specific surface area of the toner be from 1.1 to 4.0 $m^2/g$; the surface existing amount of silica atoms, which is determined employing ESCA, be from 6 to 12 percent by area; and the existing amount of carbon atoms be from 50 to 75 percent by area.

The toner of the present invention may preferably be produced employing methods described, for example, in Japanese Patent Application Open to Public Inspection Nos. 63-186253, 63-282749, and 7-146583, in which particles are prepared in an aqueous medium, and a method in which resinous particles are formed upon being salted out/fused.

The weight average particle diameter of resinous particles, employed in the method in which resinous particles are formed upon being salted out/fused, is preferably from 50 to 2,000 nm. These resinous particles may be prepared employing any granulation polymerization method such as emulsion polymerization, dispersion polymerization, and suspension polymerization. Of these, resinous particles, which are prepared employing the emulsion polymerization, are preferably employed.

The electrostatic latent image developing toner of the present invention is preferably prepared employing a so-called polymerization method, namely a method in which toner particles are prepared by polymerizing at least a polymerizable monomer in an aqueous medium. Further, toner particles are preferred which are prepared by salting out/fusing the resulting resinous particles in an aqueous medium. By employing resinous particles prepared by such a polymerization method, especially when the resinous particle are salted out/fused in an aqueous medium, it is possible to prepare toner particles having a small particle diameter, of which particle size distribution and shape are controlled.

In the following, an example of the material and the manufacturing method of a toner of this invention will be described.

(Material)

(Monomer):

As regards the polymerizable monomer, radical-polymerizable monomer is an essential component and a cross-linking agentis added as occasion demands. Besides, in addition to these, also it is appropriate to contain at least one kind of a radical-polymerizable monomer having an acidic radical or a radical-polymerizable monomer having a basic radical.

(1) The Radical-Polymerizable Monomer:

As regards the radical-polymerizable monomer, and any one of radical-polymerizable monomers can be used. Further, it is possible to use a combination of two or more kinds of them so as to make the resin have required properties.

To state it concretely, an aromatic vinyl monomer, a (meth)acrylic ester monomer, a vinyl ester monomer, vinylether monomer, a mono-olefin monomer, a di-olefin monomer, an olefin halide monomer, etc. can be used.

For the aromatic vinyl monomer, for example, styrene monomers and their derivatives such as styrene, methylstyrene, methoxylstyrene and so on can be cited.

For the (meth)acrylic ester monomer, methyl acrylate, ethyl acrylate, butyl acrylate, 2-ethylhexyl acrylate, cyclohexyl acrylate, phenyl acrylate, benzyl acrylate, methyl methacrylate, ethyl methacrylate, butyl methacrylate, hexyl methacrylate, 2-ethylhexyl methacrylate, cyclohexyl methacrylate, benzyl methacrylate etc. can be cited.

For the di-olefin monomer, butadiene, isoprene, chloroprene, etc. can be cited.

(2) Cross-Linking Agent:

For a cross-linking agent to be added for the purpose of improving the properties of a toner, a radical-polymerizable cross-linking agent is used. For the radical-polymerizable cross-linking agent one that has two or more unsaturated bonds such as divinyl benzene, divinyl naphthalene, divinyl ether, diethyleneglycol methacrylate, ethyleneglycol dimethacrylate, polyethyleneglycol dimethacrylate, diaryl phthalate, etc. can be cited.

(3) The Radical-Polymerizable Monomer Having an Acidic Radical or the Radical-Polymerizable Monomer Having a Basic Radical:

For the radical-polymerizable monomer having an acidic radical or the radical-polymerizable monomer having a basic radical, for example, a monomer containing a carboxyl radical, a monomer containing a sulfonic radical, and amine compounds such as primary amine, secondary amine, tertiary amine, and a quaternary ammonium salt can be used.

For the radical-polymerizable monomer having an acidic radical, for example, a monomer containing a carboxyl radical, a monomer containing a sulfonic radical, etc. can be used. For the monomer containing a carboxyl radical, acrylic acid, methacrylic acid, fumaric acid, maleic acid, itaconic acid, cinnamic acid, maleic mono-butyl ester, maleic mono-octyl ester, etc. can be cited.

For the monomer containing a sulfonic radical, styrene sulfonate, arylsulfosuccinic acid, octyl arylsulfosuccinate, etc. can be cited.

It is appropriate that these have a structure of a salt of an alkaline metal such as sodium or potassium or of an alkaline earth metal such as calcium.

For the radical-polymerizable monomer having a basic radical, for example, amine. To state it concretely, dimethylaminoethyl acrylate, dimethylaminoethyl methacrylate, diethylaminoethyl acrylate, diethylaminoethyl methacrylate, a quaternary ammonium salt of these four kinds of compounds can be cited.

It is desirable that the radical-polymerizable monomer having an acidic radical or the radical-polymerizable monomer having a basic radical is used from 0.1 to 15%, more preferably from 0.1 to 10% by weight to the total radical-polymerizable monomer.

(Chain-Transfer Agent)

For the purpose of adjusting the molecular weight, it is possible to use a chain-transfer agent which is generally used.

As regards the chain-transfer agent, for example, mercaptans such as octylmercaptan, dodecylmercaptan, and tert-dodecylmercaptan, carbon tetrabromide and a styrene dimer are used.

(Polymerization Initiator), Dispersion Stabilizer, Surface Active Agent):

In the present invention, a radical polymerization initiator is used as far as it is water soluble. For the water soluble radical polymerization initiator, for example, persulfate salts (potassium persulfate, ammonium persulfate, etc.), azo compounds (4,4'-azobis-4-cyanovaleric acid and its salt, 2,2'-azobis(2-amidinopropane) salt, etc.), etc. can be cited.

Further, as regards the polymerization temperature, it is possible to select any temperature so long as it is not lower than the lowest radical generation temperature of the polymerization initiator; for example, a temperature falling within a range of 50° C. to 90° C. is used. However, by using a polymerization initiator starting at normal temperature, for example, a combination of hydrogen peroxide with a reducing agent (ascorbic acid, etc.), it becomes possible to make polymerization at room temperature or at a temperature a little higher than it.

(Surface Active Agent)

In order to carry out emulsion polymerization employing said radical polymerizable monomers, the addition of surface active agents is required. Said surface active agents, which are employed for the emulsion polymerization, are not particularly limited, and the ionic surface active agents shown below may be listed as suitable examples.

For the ionic surfactant, salts of sulfonic acids (sodium dodecylbenzenesulfonate, sodium arylalkylpolyethersulfonate, sodium 3,3-disulfonicdiphenylurea-4,4-diazo-bis-amino-8-naphthol-6-sulfonate, ortho-carboxibenzene-azo-dimethylaniline, sodium 2,2,5,5-tetramethyl-triphenylmethane-4,4-diazo-bis-β-naphthol-6-sulfonate, etc.), salts of sulfuric ester (sodium dodecylsulfate, sodium tetradecylsulfate, sodium pentadecylsulfate, sodium octylsulfate, etc.), salts of fatty acid (sodium oleate, sodium laurate, sodium caprate, sodium caprylate, sodium capronate, potassium stearate, calcium oleate, etc.), etc. can be cited.

Further, in addition to the above, a nonionic surface active agent can be used. To state it concretely, polyethylene oxide, polypropylene oxide, a combination of polypropylene oxide and polyethylene oxide, ester of polyethylene glycol and higher fatty acid, alkylphenolpolyethylene oxide, ester of higher fatty acid and polyethylene glycol, ester of higher fatty acid and polypropyrene oxide, sorbitan ester, etc. can be cited.

Further, these surface active agents are used mainly at the time of emulsion polymerization, but they may be used in some other processes or for other purposes.

(Coloring Agent)

For a coloring agent, any one of inorganic pigments, organic pigments, and dyes can be used.

To state concrete examples of the inorganic pigments, as regards black pigments, for example, carbon blacks such as furnace black, channel black, acetylene black, thermal black, lampblack, etc. can be used, and magnetic particles of magnetite, ferrite, etc. can be used.

These inorganic pigments may be employed individually or in combination of a plurality of these, if desired. Further, the added amount of said pigments is commonly between 2 and 20 percent by weight with respect to the polymer, and is preferably between 3 and 15 percent by weight.

When employed as a magnetic toner, it is possible to add said magnetite. In that case, from the viewpoint of providing specified magnetic properties, said magnetite is incorporated into said toner preferably in an amount of 20 to 60 percent by weight.

Organic pigments may be employed. Specific organic pigments are exemplified below.

To state concrete examples of the organic pigments, for magenta or red pigments, for example, C. I. pigment-red 3, C. I. pigment-red 5, C. I. pigment-red 6, C. I. pigment-red 7, C. I. pigment-red 15, C. I. pigment-red 16, C. I. pigment-red 48:1, C. I. pigment-red 53:1, C. I. pigment-red 57:1, C. I. pigment-red 122, C. I. pigment-red 123, C. I. pigment-red 139, C. I. pigment-red 144, C. I. pigment-red 149, C. I. pigment-red 166, C. I. pigment-red 177, C. I. pigment-red 178, C. I. pigment-red 222, etc. can be cited.

Listed as pigments for orange or yellow are C.I. Pigment Orange 31, C.I. Pigment Orange 43, C.I. Pigment Yellow 12, C.I. Pigment Yellow 13, C.I. Pigment Yellow 14, C.I. Pigment yellow 15, C.I. Pigment Yellow 17, C.I. Pigment Yellow 93, C.I. Pigment Yellow 94, C.I. Pigment Yellow 138, C.I. Pigment yellow 180, C.I. Pigment Yellow 185, C.I. Pigment Yellow 155, C.I. Pigment Yellow 156, and the like.

For green or cyan pigments, C. I. pigment-blue 15, C. I. pigment-blue 15:2, C. I. pigment-blue 15:3, C. I. pigment-blue 16, C. I. pigment-blue 60, C. I. pigment-green 7, etc. can be cited.

To state concrete examples of dyes, C. I. solvent-red 1, C. I. solvent-red 49, C. I. solvent-red 52, C. I. solvent-red 58, C. I. solvent-red 63, C. I. solvent-red 111, C. I. solvent-red 122, C. I. solvent-yellow 19, C. I. solvent-yellow 44, C. I. solvent-yellow 77, C. I. solvent-yellow 79, C. I. solvent-yellow 81, C. I. solvent-yellow 82, C. I. solvent-yellow 93, C. I. solvent-yellow 98, C. I. solvent-yellow 103, C. I. solvent-yellow 104, C. I. solvent-yellow 112, C. I. solvent-yellow 162, C. I. solvent-blue 25, C. I. solvent-blue 36, solvent-blue 60, C. I. solvent-blue 70, solvent-blue 93, C. I. solvent-blue 95, etc. can be cited. These pigments may be used in combination.

As regards these inorganic pigments, organic pigments, and dyes, it is possible to select one or a plurality of them together for use in response to a request. Further, the quantity of a pigment to be added is 2 to 20% by weight to the polymer, and desirably, 3 to 15% by weight is selected.

It is also possible to use a coloring agent with its surface reformed. Preferable example of the surface reforming agent includes a silane coupling agent, a titanium coupling agent, an aluminum coupling agent, etc.

(Manufacturing Process)

An example of the method for producing the toner of the present invention includes:

a dissolution process in which releasing agents are dissolved in monomers and a monomer solution is prepared, a dispersion process in which the resulting monomer solution is dispersed into a water based medium, a polymerization process in which the resulting water based dispersion of said monomer solution undergoes polymerization so that a dispersion of resin particles comprising said releasing agents is prepared, (a salting-out/fusion process in which the resulting resin particles and said colorant particles are subjected to salting-out/fusion in a water based medium so as to obtain coalesced particles (toner particles), a filtration and washing process in which the resulting coalesced particles are collected from the water based medium employing filtration, and surface active agents and the like are removed from said coalesced particles, a drying process in which washed coalesced particles are dried, and an external addition process may be included in which external agents are added to the dried coalesced particles.

Non-colored particles may be employed as resin particles. In this instance the colored particles can be obtained by adding colorant particles dispersion to the resin particles dispersion and then they are subjected to fusing in an aqueous medium.

Particularly salting-out/fusion employing resin particles prepared by polymerization process is preferably employed in the fusion process. The resin particles and colorant particles may be subjected to salting-out/fusion in a water based medium when non-colored resin particles are employed.

The process of salting-out/fusion is a process in which coagulation by salting and fusion go on simultaneously. Fusion is a process in which surfaces between the resin particles extinguish, as disclosed in JP 2000-292973 A in detail.

The toner composing material such as a charge controlling agent as well as the coloring agent and releasing agent can be added in particle form in this process.

In the above description, the aqueous medium means one that is mainly composed of water, whose content is not less than 50% by weight. For a medium other than water, an organic solvent which is soluble in water can be cited; for example, methanol, ethanol, isopropanol, butanol, acetone, methylethylketone, tetrahydrofuran, etc. can be cited. It is desirable alcoholic organic solvent such as methanol, ethanol, isopropanol, or butanol which is an organic solvent not solving resin.

In the resin particle as the parent body of a toner particle, a coloring agent, a releasing agent, a charge controlling agent, etc. are contained as constituents as occasion demands. As regards these constituents of a toner, it is appropriate to employ any one of a method in which they are contained in the fine resin particles in the polymerization process for preparing the fine resin particles, and a method in which they are made to be contained in the resin particles by it that, after fine resin particles not containing these constituents of a toner are prepared, liquid in which the coloring agent, releasing agent, charge controlling agent, etc. are dispersed or dissolved is added to dispersion liquid of said fine resin particles, to fuse those fine resin particles to be bonded to one another; however, it is desirable that the releasing agent is made to be contained in the polymerization process, and the coloring agent is made to be contained in the process for fusing fine resin particles to one another.

For the polymerization process for preparing resin particles, it can be cited, for example, a method in which a solution composed of a releasing agent etc. dissolved in a polymerizable monomer is dispersed as oil drops by mechanical energy in an aqueous medium in which a surface active agent of not higher than the critical micelle concentration is dissolved, and a water soluble polymerization initiator is added to this dispersion liquid, to make radical polymerization. In this case, also it is appropriate to use an oil soluble polymerization initiator by adding it in the monomer.

As regards a dispersion machine to practice this oil drop dispersion, there is no particular limitation; for example, a ClEARMIX, an ultrasonic dispersing machine, a mechanical homogenizer, a Mantongorlin, a pressure-type homogenizer, etc. can be cited.

The coloring agent particles are prepared by dispersing the coloring agent in an aqueous medium in which a surface active agent is contained with a concentration not lower than the critical micelle concentration (CMC).

As regards the dispersing machine for dispersing the coloring agent, there is no particular limitation; desirably, pressure applying dispersion machines such as an ultrasonic dispersion machine, a mechanical homogenizer, a Mantongorlin, and a pressure-type homogenizer, and a medium-type dispersion machine such as a sand grinder, a Getzmann mill, and a diamond fine mill can be cited.

In addition, listed as employed surface active agents may be those which are the same as described above.

(Salting-Out/Fusion Process)

The salting-out/fusion process is accomplished as follows. Salting-out agent is added to water comprising resin particles as well as colorant particles as the coagulant at a concentration of higher than critical aggregation concentration. Subsequently, the resulting aggregation is heated above the glass transition point of said resin particles so that fusion is carried out while simultaneously conducting salting-out.

Herein, listed as alkali metals and alkali earth metals, employed as salting-out agents, are, as alkali metals, lithium, potassium, sodium, and the like, and as alkali earth metals, magnesium, calcium, strontium, barium, and the like. Further, listed as those forming salts are chlorides, bromides, iodides, carbonates, sulfates, and the like.

Time taken to leave standing after addition of the salting agent is controlled by monitoring the shape coefficient of the particles in fusion process by salting-out/fusion. The shorter the time is selected, the better result is obtained. Temperature to add the salting agent is preferably 30–90° C. in usual condition.

It is desirable to employ a method in which the fine resin particles are heated to their glass transition temperature or higher by raising the temperature as fast as possible. The time up to temperature raising is not more than 30 minutes, preferably not more than 10 minutes. As regards the temperature raising speed at this time, 1° C./min. or higher is desirable; the time to reach the target temperature is desirably shorter than thirty minutes, and the time shorter than ten minutes is especially desirable. The upper limit of the temperature raising speed is not particularly definite, but from the viewpoint of suppressing the generation of coarse big particles owing to a rapid progress of salting-out/fusion, a speed of 15° C./min. or slower is desirable. As an especially desirable mode of practice, if salting-out/fusion is continued to proceed even at the time when the temperature reaches or exceeds the glass transition temperature, fusion is made to effectively proceed together with the growth of the particles, and durability can be improved.

It is preferred that the toner of the invention contains a releasing agent within a toner particle. The releasing agent is incorporated uniformly within the toner particle including neighborhood of the surface by employing toner prepared by subjecting resin particles containing the releasing agent to salting-out/fusion.

For the method subjecting the particles to salting-out/fusion in a water based medium, toner in which the releasing agent is finely dispersed.

The preferable releasing agent employed invention is exemplified.

$$R^1—(OCO—R^2)_n$$

In the formula n is an integer from 1 to 4, preferably from 2 to 4, and more preferably 3 or 4.

$R^1$ and $R^2$ each represents a hydrocarbon group, which may have a substituent. The number of carbon atoms in $R^1$ is from 1 to 40, preferably from 1 to 20, and more preferably from 2 to 5.

The number of carbon atoms in $R^2$ is from 1 to 40, preferably from 16 to 30, and more preferably from 18 to 26.

Representative examples are disclosed (1)

$CH_3—(CH_2)_{12}—COO—(CH_2)_{17}—CH_3$ (2)

$CH_3—(CH_2)_{18}—COO—(CH_2)_{17}—CH_3$ (3)

$CH_3—(CH_2)_{20}—COO—(CH_2)_{21}—CH_3$ (4)

$CH_3—(CH_2)_{14}—COO—(CH_2)_{19}—CH_3$ (5)

$CH_3—(CH_2)_{20}—COO—(CH_2)_6—O—CO—(CH_2)_{20}—CH_3$ (6)

$CH_3—(CH_2)_{20}—COO—(CH_2)_2—CH(CH_3)—CH_2—O—CO—(CH_2)_{20}—CH_3$ (7)

$CH_3—(CH_2)_{22}—COO—(CH_2)_2—CH(CH_3)—CH_2—O—CO—(CH_2)_{22}—CH_3$ (8)

$CH_3—(CH_2)_{22}—COO—CH_2—C(CH_3)_2—CH_2—O—CO—(CH_2)_{22}—CH_3$ (9)

$CH_3—(CH_2)_{26}—COO—CH_2—C(CH_3)_2—CH_2—O—CO—(CH_2)_{26}—CH_3$

10)

$CH_2—O—CO—(CH_2)_{26}—CH_3$
$CH—O—CO—(CH_2)_{26}—CH_3$
$CH_2—O—CO—(CH_2)_{26}—CH_3$

11)

$CH_2—O—CO—(CH_2)_{22}—CH_3$
$CH—O—CO—(CH_2)_{22}—CH_3$
$CH_2—O—CO—(CH_2)_{22}—CH_3$

12)

$CH_2—OH$
$CH—O—CO—(CH_2)_{26}—CH_3$
$CH_2—O—CO—(CH_2)_{26}—CH_3$

13)

$CH_2—OH$
$CH—O—CO—(CH_2)_{22}—CH_3$
$CH_2—O—CO—(CH_2)_{22}—CH_3$

14)

$CH_2—OH$
$CH—OH$
$CH_2—O—CO—(CH_2)_{26}—CH_3$

15)

$CH_2—OH$
$CH—OH$
$CH_2—O—CO—(CH_2)_{22}—CH_3$

-continued (16)

$CH_3—(CH_2)_{26}—COO—CH_2—C(CH_3)(CH_2—O—CO—(CH_2)_{26}—CH_3)—CH_2—O—CO—(CH_2)_{26}—CH_3$ (17)

$CH_3—(CH_2)_{20}—COO—CH_2—C(CH_2CH_3)(CH_2—O—CO—(CH_2)_{20}—CH_3)—CH_2—O—CO—(CH_2)_{20}—CH_3$ (18)

$CH_3—(CH_2)_{26}—COO—CH_2—C(CH_2—O—CO—(CH_2)_{26}—CH_3)_3—CH_2—O—CO—(CH_2)_{26}—CH_3$ (19)

$CH_3—(CH_2)_{20}—COO—CH_2—C(CH_2—O—CO—(CH_2)_{20}—CH_3)_3—CH_2—O—CO—(CH_2)_{20}—CH_3$ (20)

$CH_3—(CH_2)_{18}—COO—CH_2—C(CH_2—O—CO—(CH_2)_{18}—CH_3)_3—CH_2—O—CO—(CH_2)_{18}—CH_3$ (21)

$CH_3—(CH_2)_{16}—COO—CH_2—C(CH_2—O—CO—(CH_2)_{16}—CH_3)_3—CH_2—O—CO—(CH_2)_{16}—CH_3$ (22)

$CH_3—(CH_2)_{20}—COO—CH_2—C(CH_2—O—CO—CH_3)_3—CH_2—O—CO—CH_3$

The content ratio of the releasing agent in the toner is commonly from 1 to 30 percent by weight, is preferably from 3 to 25 percent by weight.

Besides colorants and releasing agents, materials, which provide various functions as toner materials may be incorporated into the toner of the present invention. Specifically, charge control agents are cited. Said agents may be added employing various methods such as one in which during the salting-out/fusion stage, said charge control agents are simultaneously added to resin particles as well as colorant particles so as to be incorporated into the toner, another is one in which said charge control agents are added to resin particles, and the like.

It is possible to employ various charge control agents, which can be dispersed in water. Specifically listed are quaternary ammonium salts, fluorine compounds, azo based metal complexes, salicylic acid metal salts or metal complexes thereof.

(External Additives):

It is possible to use what is called an external additive to be added in a toner of this invention for the purpose of improving fluidity or raising the cleaning performance. As regards this external additive, there is no particular limitation, and various kinds of inorganic fine particles, organic fine particles, and a smoothing agent can be used.

For the inorganic fine particles, fine particles of silica, titania, aluminum, etc. can be desirably used. For these fine particles, hydrophobic ones are desirable. To state it concretely, as for the silica fine particles, for example, products on the market produced by Nihon Aerosil Co., Ltd. R-805, R-976, R-974, R-972, R-812, and R-809, products produced by Hoechst GmbH HVK-2150 and H-200, products on the market produced by Cabot Corp. TS-720, TS-530, TS-610, H-5, and MS-5, etc. can be cited.

For the titania fine particles, for example, products on the market produced by Nihon Aerosil Co., Ltd. T-805 and T-604, products on the market produced by TAYCA Corp. MT-100S, MT-100B, MT-500BS, MT-600, MT-600SS, and JA-1, products on the market produced by Fuji Titanium Industry Corp. TA-300SI, TA-500, TAF-130, TAF-510, and TAF-510T, products on the market produced by Idemitsu Kosan Co., Ltd. IT-S, IT-OA, IT-OB, and IT-OC, etc. can be cited.

For the alumina fine particles, for example, products on the market produced by Nihon Aerosil Co., Ltd. RFY-C and C-604, a product on the market produced by Ishihara Sangyo Co., Ltd. TO-55, etc. can be cited.

For the organic fine particles, it is possible to use spherical organic fine particles having a number-average primary particle diameter of about 10 to 2000 nm. To state it concretely, fine particles of a homopolymer of styrene, methyl methacrylate, etc. or a copolymer of these can be used.

As regards the lubricant, for example, metallic salts of higher fatty acids such as stearic acid salts of metals such as zinc, aluminum, copper, magnesium, and calcium, oleic acid salts of metals such as zinc, manganese, iron, copper, and magnesium, palmitic acid salts of metals such as zinc, copper, magnesium, and calcium, linoleic acid salts of metals such as zinc and calcium, and ricinoleic acid salts of metals such as zinc and calcium can be cited.

It is desirable that the quantity of these external additives to be added is about 0.01 to 5% by weight to the toner. These are added by means of various kinds of mixing apparatus such as a turbular mixer, a Henscel mixer, a nouter mixer, and a V-type mixing machine.

(Developer):

A toner of this invention can be used as it is as a non-magnetic or magnetic single-component developer, but it is desirable to use it by mixing with a carrier as a two-component developer.

Listed as single-component developers are a non-magnetic single-component developer, and a magnetic single-component developer.

Further, said toner is blended with a carrier and employed as a two-component developer. In this instance, employed as magnetic particles of the carrier may be conventional materials known in the art, such as metals such as iron, ferrite, magnetite, and the like, alloys of said metals with aluminum, lead and the like. Specifically, ferrite particles are preferred. The volume average particle diameter of said magnetic particles is preferably from 15 to 100 $\mu$m. and is more preferably from 25 to 80 $\mu$m.

The volume average particle size of a carrier can be measured representatively by a laser-diffraction-type particle diameter distribution measuring apparatus equipped with a wet-type dispersion machine "HELOS" (manufactured by SYMPATEC Corp.).

Preferred carrier is one in which magnetic particles are further coated with resins or a so-called resin dispersion type carrier in which magnetic particles are dispersed into resins. Resin compositions for coating are not particularly limited. For example, employed are olefin based resins, styrene based resins, styrene-acryl based resins, silicone based resins, ester based resins, or fluorine containing polymer based resins. Further, resins, which constitute said resin dispersion type carrier, are not particularly limited, and resins known in the art may be employed. For example, listed may be styrene-acryl based resins polyester resins, fluorine based resins, phenol resins, and the like.

Image Forming Method

Toner is fixed by an image forming apparatus comprising a thermal fixer.

First, an example of the image forming apparatus according to the invention is described bellow. FIG. 1 is a schematic illustration of the image forming apparatus as an example of embodiment of the invention. In the drawing, 4 is a photoreceptor as a typical example of the static latent image forming device relating to the invention. The photoreceptor comprises an aluminum drum substrate and an organic photoconductive layer (OPC) as the photosensitive layer provided on the external surface of the drum substrate. The drum is rotated in the direction of the arrow in a prescribed speed. The external diameter of the photoreceptor 4 is 60 mm in this embodiment.

In FIG. 1, a light beam for exposure is generated from a laser light source 1 according to image information read by an original image reading device which is not shown in the drawing. The light beam is distributed by a polygon mirror 2 to the perpendicular direction to the drawing paper and irradiated to surface of the photoreceptor 4 through an fθ lens 3 for calibrating the distortion of the image to form a static latent image. The photoreceptor is previously charged by a charging device 5 and rotated clockwise synchronized with timing of the image exposure.

The static latent image on the photoreceptor is developed by a developing device 6. The developed image is transferred onto a recording material 8 conveyed according to adjusted timing by the effect of a transfer device 7. The recording material 8 is separated from the photoreceptor 4 by a separating device or a separating electrode 9. The developed toner image is transferred and carried on the recording material and introduced into a fixing device 10 so as to be fixed.

The toner not transferred and remained on the photoreceptor surface is removed by cleaning device 11 having a cleaning blade 13. After the cleaning, remained charge of the photoreceptor is removed by a precharging light exposure (PCL) 12. Then the photoreceptor is uniformly charged again by the charging device 5 for next image formation.

Although the recording material is typically a sheet of paper, any material on which the non-fixed developed image can be transferred can be used. PET base for OHP is usable.

A rubber-like material having a thickness of approximately from 1 to 30 mm is used as cleaning blade 13. Urethane rubber is usually used as the material of the blade. The cleaning blade is preferably released from the photoreceptor when the image forming operation is not performed since the blade is contacted to the photoreceptor and tends to conduct heat.

Recently, a image forming method using a digital system is actively investigated in the field of the electrophotography in which a latent image is formed on the photoreceptor and developed to form a visible image, since the quality improvement, conversion and edition of image can be easily performed and a high quality image can be obtained by the digital image forming system.

As the optical scanning system in which light is modulated by a digital image signal from a computer or an original picture to be copied, (1) an apparatus in which a sonic optical modulator is inserted in the laser optical system and light is modulated by the modulator, and (2) an apparatus using a laser for directly modulating the laser light, are used. The charged photoreceptor is exposed to a light spot irradiated from such the scanning optical system to form a dot image.

The light beam irradiated from the scanning optical system has a spherical or elliptical luminance distribution like a normal distribution with an extended foot. In the case of laser beam, the shape of the light spot is very small sphere or ellipse having a diameter in the main scanning or sub-scanning or both directions of, for example, from 20 to 100 $\mu$m.

The image forming apparatus may be constituted so that a processing cartridge is installed therein, which contains at least one of the photoreceptor 4, the charging device 5, the developing device 6, the cleaning device 11 and the transfer device 7.

EXAMPLES

The present inventing will now be detailed with reference to examples. Incidentally, "parts" in the following description is parts by weight, unless otherwise specified.

Preparation of Toner and Developer

1. Preparation of Resin Particles of a Toner

Preparation of Latex 1HLM (1) Preparation of Core Particle (The First Step of Polymerization)

In a 5,000 ml separable flask with a stirrer, a thermal sensor, a cooler and a nitrogen supplying apparatus, a surfactant solution composed of 3,010 g of ion-exchanged water and, dissolved therein, 7.08 g of anionic surfactant (101), $C_{10}H_{21}(OCH_2CH_2)_2OSO_3Na$, was charged as an aqueous medium. The temperature of the content was raised up to 80° C. while stirring at 230 rpm under a nitrogen gas stream.

Into the surfactant solution, an initiator solution composed of 9.2 g of polymerization initiator, potassium persulfate KPS, dissolved in 200 g of ion exchanged water and the temperature of the content was adjusted to 75° C. Then a monomer mixture liquid composed of 70.1 g of styrene, 19.9 g of n-butyl acrylate and 10.9 g of acrylic acid was dropped into the solution spending 1 hour. This system was heated and stirred for 2 hours for carrying out polymerization or the first step of polymerization. Thus latex, a dispersion of resin particle comprising a high molecular weight resin, was prepared. The latex was referred to as Latex H.

(2) Formation of Interlayer (The Second Step of Polymerization)

In a flask with a stirrer, 98.0 g of Exemplified Compound 19 was added as a releasing agent to a monomer mixture liquid composed of a 105.6 g of styrene, 30.0 g of n-butyl acrylate, 6.2 g of methacrylic acid and 5.6 g of n-octyl-3-mercaptopropionic acid ester. The content was heated at 90° C. for dissolving the releasing agent. Thus Monomer Solution was prepared.

Besides, a surfactant solution composed of 2700 ml of ion exchanged water and, dissolved therein, 1.6 g of the foregoing anionic Surfactant A was heated by 98° C. and 28 g in terms of the solid ingredient of the dispersion of the core particle Latex 1H was added to the surfactant solution. Then the foregoing Monomer Solution was mixed into the surfactant solution containing Latex 1H by a mechanical dispersing machine CLEARMIX having a circulation channel, manufactured by M-Tech Co., Ltd., and dispersed for 8 hours to prepare an emulsion which contains emulsified particles (oil drops).

Then, an initiator solution composed of 240 ml of ion-exchanged water and, dissolved therein, 5.1 g of the polymerization initiator KPS and 750 ml of ion-exchanged water was added to the emulsion. This system was heated and stirred at 98° C. for 12 hours for carrying out polymerization, the second step of polymerization. Thus latex, a dispersion of a combined resin particle comprising the high molecular weight resin particle covered by an intermediate molecular weight resin was prepared. This latex was referred to as Latex 1HM.

(3) Formation of Outer Layer (The Third Step of Polymerization)

To the foregoing Latex 1HM, an initiator solution composed of 200 ml of ion-exchanged water and, dissolved therein, 7.4 g of the polymerization initiator KPS was added and a monomer mixture of 300 g of styrene, 95 g of n-butyl acrylate, 15.3 g of methacrylic acid, and 10.4 g of n-octyl-3-mercaptopropionic acid ester was dropped spending 1 hour.

After the dropping, polymerization, the third step of polymerization was carried out by heating and stirring for 2 hours. Then the reaction liquid was cooled by 27° C. Thus latex, a dispersion of a combined resin particle comprising core particle of the high molecular weight resin, an inter layer of the middle molecular weight resin containing exemplified compound 19, and an outer layer of low molecular weight resin was prepared. This latex was referred to as Latex 1HML.

The combined resin particle of Latex 1HML has peaks of molecular weight distribution at 138,000, 80,000 and 13,000, and the weight average particle diameter of the resin particle was 122 nm.

Preparation of Latex 2HML

Latex 2HML was prepared in the same manner as in Latex 1HML except that an anionic surfactant sodium dodecylsulfonate SDS, was used in place of anionic Surfactant (101). Latex 2HML was composed of a combined resin particle comprising core particle of the high molecular weight resin, an inter layer of the middle molecular weight resin, and an outer layer of low molecular weight resin was prepared.

The combined resin particle of Latex 2HML has peaks of molecular weight distribution at 138,000, 80,000 and 12,000, and the weight average particle diameter of the resin particle was 110 nm.

Preparation of Toner 1

In 1,600 ml of ion-exchanged water, 59.0 g of anionic Surfactant (101) was dissolved by stirring. To the solution, 420.0 g of Carbon black Regal 330, manufactured by Cabot Co., Ltd., was gradually added and dispersed by CLEARMIX, manufactured by M-Tech Co., Ltd., to prepare a dispersion of the colorant particle. The dispersion of the colorant was referred to as Colorant Dispersion 1. The weight average diameter of the colorant particle in Colorant Dispersion 1 was 98 nm according to the measurement by electrophoresis light scattering photometer ELS-800, manufactured by OTSUKA ELECTRONICS CO., LTD.

In a four mouth flask as the reaction vessel to which a thermal sensor, cooler, nitrogen conduction apparatus and stirrer were attached, 420.7 g in terms of solid component of the foregoing Latex 1HML, 900 g of ion-exchanged water 166 g of Colorant Dispersion 1 were charged and stirred. The content was heated by 30° C. and the pH of the liquid was adjusted to 9.0 by the addition of a sodium hydroxide solution having a concentration of 5 moles/liter.

Subsequently, an aqueous solution, prepared by dissolving 12.1 g of magnesium chloride hexahydrate in 1,000 ml of deionized water, was added while stirring at 30° C. over a period of 10 minutes. The resulting mixture was set aside for three minutes and then heated. The mixture was heated to 96° C. over a period of three minutes and was subjected to formation of salted-out/fused particles. In such a state, the circle-equivalent diameter, circularity, and particle diameter were determined employing FPIA-2000 which was fitted inline with the reaction vessel. When reaching the specified values, particle growth was terminated by adding an aqueous solution prepared by dissolving 2 g of sodium chloride in 1,000 ml of deionized water. Thereafter, the particles were allowed to grow by 0.2 to 1.0 μm and the circularity gradient with respect to the circle-equivalent diameter was then adjusted.

Thereafter, the resulting product was cooled to 30° C. and the pH was adjusted to 2.0 by adding hydrochloric acid. Subsequently, stirring was stopped, the formed salted-out/fused particles were filtered and then repeatedly washed, employing 45° C. deionized water. Further, the resulting particles were dried employing 40° C. airflow, and 0.8 part by weight of hydrophobic silica and 1.0 part by weight of hydrophobic titanium oxide were added. The resulting mixture was blended for 25 minutes, employing a 10,000 ml Henschel mixer in which the peripheral rate of the rotation blades was set at 30 m/s, whereby Toner 1 was prepared.

(Production of Toners 2 Through 5)

In the production of Toner 1, latex (1HML) was replaced with latex (2HML). Further, during formation of salted-out/fused particles, when the circle-equivalent diameter and the circularity of the resulting salted-out/fused particles reached 2.5 μm and 0.987, respectively, particle growth was terminated by adding an aqueous solution prepared by dissolving 8 g of sodium chloride in 1,000 ml of deionized water. Further, particle fusion was allowed to continue while stirring and heating, whereby a colorant particle dispersion was prepared. The resulting colorant particle dispersion was designatfed as Colorant Particle Dispersion S. On the other hand, during formation of coalesced particles, when the circle-equivalent diameter and the circularity of the coalesced particles reached 7.8 μm and 0.875, respectively, particle growth was terminated by adding an aqueous solution prepared by dissolving 80 g of sodium chloride in 1,000 ml of deionized water. Subsequently, the resulting particles were subjected to the same treatment as above, whereby Colorant Particle Dispersion L was prepared. Subsequently, Colorant Particle Dispersion S and Colorant Particle Dispersion L were blended while monitoring the circle-equivalent diameter, circularity, and particle diameter of particles employing FPIA-2000. When reaching the specified values, the resulting dispersion was cooled to 30° C. Subsequently, the pH was adjusted to 2.0 by adding hydrochloric acid and stirring was then stopped. The resulting coalesced particles were filtered and washed repeatedly with 45° C. deionized water. Thereafter, 0.8 part by weight of hydrophobic silica and 1.0 part by weight of hydrophobic titanium oxide were added. The resulting mixture was mixed for 25 minutes, employing a 10,000 ml Henschel mixer in which the peripheral rate of the rotation blades was set at 30 m/s, whereby Toners 2 through 5, shown in Table 1, were prepared.

(Production of Comparative Toner 1)

Charged into a reaction vessel (being a four-necked flask) fitted with a temperature sensor, a cooling pipe, a nitrogen inlet unit, and a stirring unit were 420.7 g (in terms of solids) of latex (1HML), 900 g of deionized water, and 166 g of a colorant dispersion, and the resulting mixture was stirred. The temperature of the interior of the vessel was adjusted to 30° C. Thereafter, the pH of the solution was adjusted to 9.5 by adding an aqueous sodium hydroxide solution.

Subsequently, an aqueous solution prepared by dissolving 12.1 g of magnesium chloride hexahydrate in 1,000 ml of deionized water was added while stirring at 30° C. over a period of 10 minutes. Thereafter, the resulting mixture was set aside for 3 minutes and was then heated to 90° C. over a period of 60 minutes, whereby coalesced particles were grown. When the circle-equivalent diameter reached 3.5 μm, particle growth was terminated by adding an aqueous solution prepared by dissolving 8.04 g of sodium chloride in 1,000 ml of deionized water. Further, as a ripening treatment, the resulting mixture was agitated at 98° C. for 12 hours.

Thereafter, the resulting product was cooled to 30° C. and the pH was adjusted 2.0 by adding hydrochloric acid, followed by the termination of stirring. The resulting coalesced particles were filtered and washed repeatedly with 45° C. deionized water. Subsequently, the resulting particles were dried employing 45° C. airflow. Thereafter, 0.8 part by weight of hydrophobic silica and 1.0 part by weight of hydrophobic titanium oxide were added. The resulting mixture was blended for 25 minutes, employing a 10,000 ml Henschel mixer in which the peripheral rate of the rotation blades was set at 30 m/s, whereby Comparative Toner 1 was prepared.

Subsequently, Comparative Toners 2 through 5 were prepared in the same manner as Toners 2 though 5, while adjusting the mixing ratio of Colorant Particle Dispersions S and L.

Table 1 shows the circularity average, the circle-equivalent diameter average, the circularity gradient with respect to the circle-equivalent diameter, the BET specific area, and the surface existing amount of silicon atoms determined by ESCA, and the existing amount of carbon atoms of Toners 1 through 5 as well as Comparative Toners 1 through 4, prepared as above.

TABLE 1

| | Circularity Average | Circle-Equivalent Diameter Average (in μ) | Circularity Gradient versus Circle-Equivalent Diameter | $d_{90}/d_{10}$ | $R^2$ | BET Specific Surface Area (in $m^2/g$) | Existing Amount of Silicon Atoms (in area %) | Existing Amount of Carbon Atoms (in area %) |
|---|---|---|---|---|---|---|---|---|
| Example 1 | 0.96 | 4.4 | −0.031 | 1.61 | 0.90 | 1.65 | 9.5 | 68.1 |
| Example 2 | 0.95 | 6.4 | −0.038 | 1.71 | 0.85 | 1.43 | 7.3 | 70.3 |

TABLE 1-continued

| | Circularity Average | Circle-Equivalent Diameter Average (in μ) | Circularity Gradient versus Circle-Equivalent Diameter | $d_{90}/d_{10}$ | $R^2$ | BET Specific Surface Area (in $m^2/g$ | Existing Amount of Silicon Atoms (in area %) | Existing Amount of Carbon Atoms (in area %) |
|---|---|---|---|---|---|---|---|---|
| Example 3 | 0.97 | 3.5 | −0.021 | 1.41 | 0.65 | 1.22 | 6.5 | 66.7 |
| Example 4 | 0.94 | 7.3 | −0.047 | 1.76 | 0.48 | 3.87 | 10.5 | 61.1 |
| Example 5 | 0.98 | 2.7 | −0.014 | 1.25 | 0.41 | 1.46 | 7.9 | 67.3 |
| Example 6 | 0.94 | 7.1 | −0.045 | 1.75 | 0.47 | 4.05 | 13.3 | 76.5 |
| Comp. Example 1 | 0.96 | 5.3 | 0.000 | 1.56 | 0.00 | 1.05 | 8.8 | 76.5 |
| Comp. Example 2 | 0.97 | 4.5 | −0.058 | 1.41 | 0.65 | 1.04 | 5.1 | 73.4 |
| Comp. Example 3 | 0.98 | 4.8 | −0.008 | 1.76 | 0.32 | 4.21 | 9.7 | 75.1 |
| Comp. Example 4 | 0.92 | 7.6 | −0.040 | 1.58 | 0.98 | 4.16 | 4.5 | 76.2 |

Comp.: Comparative

Production of Carrier

Production of Ferrite Core Materials

A mixture consisting of 18 mol percent of MnO, 4 mol percent of MgO, and 78 mol percent of $Fe_2O_3$ was crushed for 2 hours, employing a wet ball mill, blended and dried. Thereafter, the resulting mixture was temporarily burned while maintained at 900° C. for 2 hours, and subsequently crushed for 3 hours to form a slurry. Dispersing agents and binders were added, and the resulting mixture was subjected to granulation, employing a spray drier, and subsequently dried. Thereafter, said granulated mixture was subjected to the main burning at 1,200° C. for 3 hours, whereby ferrite core material particles having a resistance of $4.3\times10^8$ Ω·cm were prepared.

Production of Covering Resin

Initially, a cyclohexyl methacrylate/methyl methacrylate (at a copolymerization ratio of 5/5) copolymer was synthesized employing an emulsion polymerization method in which the concentration in an aqueous solution medium employing sodium benzenesulfonate having an alkyl group having 12 carbon atoms as a surface active agent, and fine resinous particles were obtained having a volume average primary particle diameter of 0.1 μm, a weight average molecular weight (Mw) of 200,000, a number average molecular weight (Mn) of 91,000, an Mw/Mn of 2.2, a softening temperature (Tsp) of 230° C., and a glass transition temperature (Tg) of 110° C. Incidentally, said fine resinous particles were treated to be azeotropic with water and the residual monomer amount was adjusted to 510 ppm.

Subsequently, charged into a high-speed mixer employing stirring blades were 100 parts by weight of ferrite core material particles and 2 parts by weight of said fine resinous particles, and the resulting mixture was blended at 120° C. for 30 minutes, and utilizing mechanical impact force action, a resin coated carrier having a volume average particle diameter of 61 μm was prepared.

Production of Developer

Each type of colored particles added with external additives was blended with said carrier, and a developer, having a toner concentration of 6 percent by weight, was prepared.

Production of Photoreceptor P1

The coating compositions described below were applied onto a cylindrical conductive support having a diameter of 60 mm, whereby photoreceptor P1 was prepared.

| <Sublayer> | |
|---|---|
| Titanium chelate compound (TC-750, manufactured by Matsumoto Seiyaku Co.) | 30 g |
| Silane coupling agent (KMB-503, manufactured by Shin-Etsu Kagaku Co.) | 17 g |
| 2-Propanol | 150 ml |

Said coating composition was applied onto a cylindrical conductive support so as to obtain a layer thickness of 0.5 μm.

| <Charge Generating Layer> | |
|---|---|
| Y type titanyl phthalocyanine (titanyl phthalocyanine having a maximum peak at 27.2 degrees of Bragg angle 2θ (±0.2 degree) in Cu-Kα characteristic X-ray diffraction spectrometry) | 60 g |
| Silicone modified butyral resin (X-40-1211M, manufactured by Shin-Etsu Kagaku Co.) | 700 g |
| 2-Butanone | 2000 ml |

were mixed and dispersed for 10 hours employing a sand mill, whereby a charge generating layer coating composition was prepared.

The resulting coating composition was applied onto said sublayer employing a dip coating method, whereby a 0.2 μm thick charge generating layer was formed.

| <Charge Transport Layer> | |
|---|---|
| Charge transport material N-(4-methylphenyl)-N-{4-(β-phenylstyryl)phenyl}-p-toluidine | 225 g |
| Polycarbonate (having a viscosity average molecular weight of 30,000) | 300 g |
| Antioxidant (Exemplified Compound 1-3) | 6 g |
| Dichloromethane | 2000 ml |

were mixed and dissolved to prepare a charge transport layer coating composition. The resulting coating composition was applied onto said charge generating layer employing a dip coating method, whereby a charge transport layer having a dried layer thickness of 20 μm was formed.

| <Protective Layer> | |
|---|---|
| Methyltrimethoxysilane | 150 g |
| Dimethyldimethoxysilane | 30 g |
| Reactive charge transport compound (Exemplified Compound B-1) | 15 g |
| Polyfluorinated vinylidene particles (having a volume average particle diameter of 0.2 μm) | 10 g |
| Antioxidant (Exemplified Compound 2-1) | 0.75 g |
| 2-Propanol | 75 g |
| 3 Percent acetic acid | 5 g |

were mixed to prepare a resinous layer coating composition. The resulting coating composition was applied onto said charge transport layer, employing a circular amount regulating type coating device so as to form a 2 μm thick resinous layer. The resulting layer was thermally hardened at 120° C. for one hour to form a siloxane resinous layer, whereby Photoreceptor P1 was prepared.

Photoreceptor P1 and each of developers were installed in a digital copier (comprising corona charging, laser exposure, reversal development, electrostatic transfer claw separation, and a cleaning blade) having image forming processes described in FIG. 1, and subsequently evaluated. Evaluation was carried out while setting said digital copier at the following conditions.

Charging Condition

Charging unit: scorotron charging unit. The initial charge potential was set at −750 V.

Exposure Condition

Exposure amount was set to result in an exposed area potential of −50 V.

Development Conditions

DC bias: −550 V

Transfer electrode: corona charging system

Further, the employed fixing unit comprised a heating roller having a surface roughness Ra of 0.8 μm, which was prepared by covering the surface of an iron cylinder with a 25 μm thick PFA (a tetrafluoroethylene-perfluoroalkyl vinyl ether copolymer) and a pressing roller having a surface roughness Ra of 0.8 μm, which was prepared by covering an iron cylinder with HTV silicone rubber which was further covered with a 120 μm thick PFA tube. Incidentally, its nip width was 3.8 mm and a linear rate was 420 mm/second.

Further, said cleaning unit was provided with neither a cleaning mechanism nor a silicone oil supplying mechanism. Fixing temperature was controlled employing said heating roller and set at 165° C.

As copying conditions, 1,000,000 copies were continuously prepared at low temperature and low humidity (10° C. and 20 percent relative humidity). The off-setting resistance of copied images, the staining during bookbinding, the standard glossiness, the cleaning properties, the filming generation of the photoreceptor were evaluated based on the criteria described below.

An original image consisting of equal quarters of a text image having a pixel ratio of 7 percent, a portrait picture image, a solid white image, and a solid black image was copied onto A4 acid-free paper sheets. At every 10,000th copy, halftone images, solid white images, solid black images and fine line images were evaluated.

Uniformity of Halftone

After continuous production of 1,000,000 copies, the photoreceptor filming as well as the uniformity of halftone images due to variation of transferability was evaluated based on the rank described below.

Rank A: uniform image without mottles

Rank B: presence of very slight streak-shaped mottles

Rank C: presence of several slight streak-shaped mottles, which are commercial viable Rank D: presence of more than several clear streak-shaped mottles Evaluation ranks A, B, and C were judged to be commercially viable and D was judged to be not commercially viable.

Minute Spots around Dot

A halftone dot image, which occupied 10 percent of the whole image, was prepared. Subsequently, tiny spots around dots were observed employing a hand magnifier, and evaluated based on the criteria described below.

A: tiny spots were barely noticed

B: there were slightly tiny spots, but if they were not carefully observed, they would not be noticed C: tiny spots were easily noticed Selective Developability After copying 100,000 sheets, toner in the development unit was recovered. Subsequently, the circularity of recovered toner particles was determined employing FPIA-2000 (produced by Sysmex Corporation). When $d_{90}/d_{10}$ exceeds 4.5, toner is markedly scattered, whereby staining in the interior of the apparatus becomes noted.

Selective Transferability

After every 100,000 sheets of copying, the toner, which had not been transferred, in the toner recycling unit, which returned the toner recovered by the cleaning blade to the development unit, was recovered. Subsequently, the circularity of the recovered toner particles was determined employing FPIA-2000 (produced by Sysmex Corporation). The number of sheets, in which $d_{90}/d_{10}$ of the toner which had not been transferred exceeded 4.5, was utilized for evaluation. When $d_{90}/d_{10}$ exceeds 4.5, toner is markedly scattered in the same manner as the case of the aforesaid selective developability, whereby staining of the interior of the apparatus becomes noted.

Further, after every 100,000 sheets of copying, toner filming on the photoreceptor, as well as toner filming on the development roller, was visually evaluated by observing the surface of the photoreceptor as well as the development roller. The results were then recorded.

TABLE 2

| | Half-tone Uni-form-ity | Minute Dot Dust | Toner Filming on Photo-receptor | Tonor Filming on Development Roller | Selective Develop-ability ($d_{90}/d_{10}$ of tonor in devel-opment unit) | Selective Transferabili-ity (the number of copied sheets which results in $d_{90}/d_{10}$ > 4.5 with toner in the cleaning unit) |
|---|---|---|---|---|---|---|
| Exam-ple 1 | A | A | no generation until 1,000,000th sheet | no generation until 1,000,000th sheet | 2.6 | at least 1,000,000 sheets |
| Exam-ple 2 | A | B | no generation until 1,000,000th sheet | no generation until 1,000,000th sheet | 2.7 | at least 1,000,000 sheets |
| Exam-ple 3 | A | B | no generation until 1,000,000th sheet | no generation until 1,000,000th sheet | 2.4 | at least 1,000,000 sheets |
| Exam-ple 4 | A | C | no generation until 1,000,000th sheet | no generation until 1,000,000th sheet | 2.8 | at least 1,000,000 sheets |
| Exam-ple 5 | A | C | no generation until 1,000,000th sheet | no generation until 1,000,000th sheet | 2.2 | at least 1,000,000 sheets |
| Exam-ple 6 | A | C | no generation until 1,000,000th sheet | no generation until 1,000,000th sheet | 4.8 | 600,000 sheets |
| Comp. Exam-ple 1 | B | D | generated at 200,000th sheet | generated at 200,000th sheet | 4.8 | 100,000 sheets |
| Comp. Exam-ple 2 | B | D | generated at 50,000th sheet | generated at 50,000th sheet | 5.1 | 50,000 sheets |
| Comp. Exam-ple 3 | B | D | generated at 20,000th sheet | generated at 20,000th sheet | 6.4 | 20,000 sheets |
| Comp. Exam-ple 4 | B | D | generated at 20,000th sheet | generated at 20,000th sheet | 6.5 | 20,000 sheets |

Comp.: Comparative

As can clearly be seen from Table 2, Examples 1 through 5, included in the present invention, exhibited excellent results for all the evaluation items, while Comparative Examples 1 through 4, which were not included in the present invention, resulted in problems.

The present invention is capable of providing a toner capable of forming high quality images in such a manner that even though a heating roller fixing system is employed, while combining with a polymerization method toner comprised of toner particles with a small diameter and uniform particle size distribution as well as uniform shape, the toner particles are sufficiently deformed so as to fit into the unevenness of the heating roller surface and results in sufficient fixing, and an image forming method as well as an image forming apparatus using the same.

What is claimed is:

1. An electrostatic latent image developing toner comprising toner particles wherein an average of circularity of the toner particles is from 0.94 to 0.98; an average of circle equivalent diameter of the toner particles is from 2.6 to 7.4 $\mu$m; and gradient of the circularity of the toner particles with respect to the circle-equivalent diameter is from −0.050 to −0.010.

2. The electrostatic latent image developing toner of claim 1, wherein the average of the circle-equivalent diameter is from 3.4 to 6.6 pm, and the gradient of the circularity with respect to the circle-equivalent diameter is from −0.040 to −0.020.

3. The electrostatic latent image developing toner of claim 2, wherein ratio $d_{90}/d_{10}$ is from 1.2 to 2.0, wherein $d_{10}$ is a circular-equivalent diameter of the toner particles at an accumulation of 10 percent and $d_{90}$ is the circle-equivalent diameter of the toner particles at an accumulation of 90 percent.

4. The electrostatic latent image developing toner of claim 2, wherein the toner particles are prepared by salting out/fusing at least resinous particles in an aqueous medium.

5. The electrostatic latent image developing toner of claim 2, wherein the average circularity is from 0.93–0.97.

6. The electrostatic latent image developing toner of claim 2, having $R^2$ of 0.35–0.95, wherein $$R = \frac{n(\sum XY) - (\sum X \sum Y)}{[n\sum X^2 - (\sum X)^2][n\sum Y^2 - (\sum Y)^2]}.$$

7. The electrostatic latent image developing toner of claim 6, wherein the toner particles are prepared by salting out/fusing at least resinous particles in an aqueous medium.

8. The electrostatic latent image developing toner of claim 7, comprising a compound represented by following formula:

$$R1\text{-}(OCOR2)_n$$

wherein n is either of an integer from 1 to 4, R1 and R2 each independently represents a hydrocarbon group or substituted hydrocarbon group.

9. The electrostatic latent image developing toner of claim 1, wherein ratio $d_{90}/d_{10}$ is from 1.2 to 1.8, wherein $d_{10}$ is a circular-equivalent diameter of the toner particles at an accumulation of 10 percent and $d_{90}$ is the circle-equivalent diameter of the toner particles at an accumulation of 90 percent.

10. The electrostatic latent image developing toner of claim 1, wherein the toner particles are prepared by polymerizing at least a polymerizable monomer in an aqueous medium.

11. The electrostatic latent image developing toner of claim 1, wherein the toner particles are prepared by salting out/fusing at least resinous particles in an aqueous medium.

12. The electrostatic latent image developing toner of claim 1, wherein BET specific surface area of the toner particles is from 1.1 to 4.0 $m^2/g$, the surface existing ratio of silicon atoms determined employing ESCA is from 6 to 12 percent by area, and the existing ratio of carbon atoms determined employing ESCA is from 50 to 75 percent by area.

13. An electrostatic latent image developing material comprising a toner and a magnetic carrier, wherein the toner is that of claim 1.

14. A method of forming a toner image, comprising:

electrically charging a photoreceptor;

imagewise exposing the photoreceptor so that a latent image is formed on the photoreceptor;

developing the latent image with toner so that a toner image is formed on the photoreceptor;

wherein the toner of claim 1 is employed.

15. A method of claim 14 wherein the imagewise exposing is carried out employing digital exposure.

16. The method of claim 15, wherein the average of the circle-equivalent diameter is from 3.4 to 6.6 $\mu$m, and the gradient of the circularity with respect to the circle-equivalent diameter is from −0.040 to −0.020.

17. The method of claim 16, wherein ratio $d_{90}/d_{10}$ is from 1.2 to 2.0, wherein $d_{10}$ is a circular-equivalent diameter of the toner particles at an accumulation of 10 percent and $d_{90}$ is the circle-equivalent diameter of the toner particles at an accumulation of 90 percent.

18. The method of claim 17, wherein the toner particles are prepared by salting out/fusing at least resinous particles in an aqueous medium.

19. The method of claim 17, wherein the average circularity is from 0.93–0.97.

20. The method of claim 17, wherein the toner has $R^2$ of 0.35–0.95, wherein $$R = \frac{n(\sum XY) - (\sum X \sum Y)}{[n\sum X^2 - (\sum X)^2][n\sum Y^2 - (\sum Y)^2]}.$$

21. The method of claim 20, wherein the toner particles are prepared by salting out/fusing at least resinous particles in an aqueous medium.

22. The method of claim 21, wherein the toner comprises a compound represented by following formula $$R1\text{-}(OCOR2)_n$$

wherein n is either of an integer from 1 to 4, R1 and R2 each independently represents a hydro-carbon group or substituted hydrocarbon group.

23. The method of claim 15 wherein the average circularity is from 0.93–0.97.

24. The method of claim 15, wherein the toner has R2 of 0.35–0.95, wherein $$R = \frac{n(\sum XY) - (\sum X \sum Y)}{[n\sum X^2 - (\sum X)^2][n\sum Y^2 - (\sum Y)^2]}.$$

25. The method of claim 15, wherein BET specific surface area of the toner particles is from 1.1 to 4.0 m.sup.2/g, the surface existing ratio of silicon atoms determined employing ESCA is from 6 to 12 percent by area, and the existing ratio of carbon atoms determined employing ESCA is from 50 to 75 percent by area.

26. The electrostatic latent image developing toner of claim 1, wherein the average circularity is from 0.93–0.97.

27. The electrostatic latent image developing toner of claim 1, having $R^2$ of 0.35–0.95, wherein $$R = \frac{n(\sum XY) - (\sum X \sum Y)}{[n\sum X^2 - (\sum X)^2][n\sum Y^2 - (\sum Y)^2]}.$$

* * * * *